US010856078B1

(12) United States Patent
Happes

(10) Patent No.: US 10,856,078 B1
(45) Date of Patent: Dec. 1, 2020

(54) SYSTEMS AND METHODS FOR AUDIO FEEDBACK ELIMINATION

(71) Applicant: Bose Corporation, Framingham, MA (US)

(72) Inventor: Marc Brandon Happes, Westford, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/428,217

(22) Filed: May 31, 2019

(51) Int. Cl.
*H04R 3/02* (2006.01)
*H04R 3/12* (2006.01)
*H04R 29/00* (2006.01)

(52) U.S. Cl.
CPC ..... *H04R 3/02* (2013.01); *H04R 3/12* (2013.01); *H04R 29/001* (2013.01); *H04R 2430/01* (2013.01)

(58) Field of Classification Search
CPC ..... H04R 3/02; H04R 3/12; H04R 29/001; H04R 2430/01
USPC ..... 381/93
See application file for complete search history.

(56) References Cited

U.S. PATENT DOCUMENTS 4,088,835 A 5/1978 Thurmond et al.
5,010,570 A 4/1991 Kobylarz et al.
5,245,665 A 9/1993 Lewis et al.
5,677,987 A * 10/1997 Seki ..... H04R 3/02 381/83
8,634,575 B2 1/2014 Williams
9,002,029 B2 4/2015 Tanaka
9,031,258 B2 5/2015 Kitago et al.
9,036,829 B2 5/2015 Lee
10,009,685 B2 6/2018 Hu et al.
10,244,306 B1 3/2019 Ku et al.
2005/0094827 A1 5/2005 McDermott et al.
2009/0041272 A1* 2/2009 Puder ..... H04R 25/453 381/318
2009/0304197 A1 12/2009 Joiner et al.
(Continued)

FOREIGN PATENT DOCUMENTS

EP 1718110 11/2006
EP 3364666 A1 8/2018

OTHER PUBLICATIONS

International Search Report and the Written Opinion of the International Searching Authority, International Application No. PCT/US2020/035300, pp. 1-12, dated Sep. 22, 2020.

*Primary Examiner* — David L Ton
(74) *Attorney, Agent, or Firm* — Bond, Schoeneck & King, PLLC

(57) ABSTRACT

An audio system and method for eliminating audio feedback including a first audio input arranged to receive a first audio signal, a first audio output arranged within a first predefined zone, the first audio output arranged to receive the first audio signal, a second audio output arranged within the first predefined zone, the second audio output arranged to receive the first audio signal, and one or more processors connected to a virtual matrix including a plurality of virtual channels connecting the first audio input, the first audio output, and the second audio output, and the one or more processors arranged to receive the first audio signal and attenuate or eliminate the first audio signal to the first audio output or the second audio output if an audio feedback is detected.

20 Claims, 7 Drawing Sheets

(56) References Cited

U.S. PATENT DOCUMENTS

| | | | |
|---|---|---|---|
| 2015/0124998 | A1 | 5/2015 | Siegel et al. |
| 2017/0188147 | A1 | 6/2017 | Da Silva Freitas et al. |
| 2017/0352357 | A1 | 12/2017 | Fink |
| 2018/0219922 | A1 | 8/2018 | Bryans et al. |

* cited by examiner

SYSTEMS AND METHODS FOR AUDIO FEEDBACK ELIMINATION

BACKGROUND

This disclosure generally relates to audio systems and methods, in particular, systems and methods for eliminating audio feedback.

SUMMARY OF THE DISCLOSURE

The present disclosure is directed to systems and methods for eliminating feedback between audio inputs and audio outputs utilizing digital signal processing arranged between the audio inputs and the audio outputs. Utilizing digital signal processing between the audio inputs and audio outputs allows for each audio input signal to be discretely routed, attenuated, and/or eliminated such that if audio feedback between a first audio input and an first audio output is detected, the audio signal between the first audio input and the first audio output can be attenuated or eliminated while leaving the audio signals to any additional audio output unaffected. Alternatively, a processor for performing the digital signal processing may apply a gain to the audio signal between the first audio input and the second audio output to compensate for the loss from the attenuated or eliminated audio signal between the first audio input and the first audio output.

Generally, in one aspect, an audio system is provided for eliminating audio feedback including a first audio input arranged to receive a first audio signal, a first audio output arranged within a first predefined zone, the first audio output arranged to receive the first audio signal, a second audio output arranged within the first predefined zone, the second audio output arranged to receive the first audio signal, one or more processors connected to a virtual matrix including a plurality of virtual channels connecting the first audio input, the first audio output, and the second audio output, and the one or more processors arranged to receive the first audio signal and attenuate or eliminate the first audio signal to the first audio output or the second audio output if an audio feedback is detected by the one or more processors.

In an example, a first processor of the one or more processors includes the virtual matrix and a second processor of the one or more processors is arranged to receive the first audio signal and attenuate or eliminate the first audio signal if the audio feedback is detected.

In an example, the one or more processors utilize audio feedback detection to detect the audio feedback between the first audio input and the first audio output or the audio second output.

In an example, the plurality of virtual channels of the virtual matrix comprises a first virtual input channel arranged between the first audio input and the first audio output and between the first audio input and the second audio output.

In an example, the one or more processors are arranged to detect the audio feedback between the first audio input and the first audio output and attenuate, via the first virtual input channel, the first audio signal and provide an attenuated signal to the first audio output.

In an example, the one or more processors are arranged to provide a gain to the second audio output in the first predefined zone to compensate for the attenuated signal to the first audio output.

In an example, the one or more processors are arranged to detect the audio feedback between the first audio input and the first audio output and eliminate, via the first virtual channel, the first audio signal to the first audio output.

In an example, the one or more processors are arranged to provide a gain to the second audio output in the first predefined zone to compensate the eliminated signal to the first audio output.

In an example, the audio system further includes a first virtual cross-point arranged between the first virtual input channel and a first virtual output channel connected to the first audio output; and, a second virtual cross-point arranged between the first virtual input channel and a second virtual output channel connected to the second audio output.

In an example, the one or more processors utilize audio feedback detection at the first virtual cross-point and the second virtual cross-point to detect the audio feedback between the first audio input and the first audio output or between the first audio input and the second audio output, and attenuate or eliminate the first audio signal to the first audio output or the second audio output.

In an example, the one or more processors are arranged to attenuate the first audio signal through the first virtual cross-point and provide a gain to the first audio signal through the second virtual cross-point, and wherein the one or more processors are arranged to eliminate the first audio signal through the first virtual cross-point and provide a gain to the first audio signal through the second virtual cross-point.

In another aspect, there is provided an audio system for eliminating audio feedback including a first audio input arranged to receive a first audio signal, a first audio output arranged within a first predefined zone, the first audio output arranged to receive the first audio signal, one or more processors connected to a virtual matrix including a plurality of virtual channels connecting the first audio input and the first audio output, the one or more processors arranged to receive the first audio signal and attenuate the first audio signal to the first audio output if an audio feedback is detected.

In an example, a first processor of the one or more processors includes the virtual matrix and a second processor of the one or more processors is arranged to receive the first audio signal and attenuate the first audio signal if the audio feedback is detected.

In an example, the one or more processors utilize audio feedback detection to detect the audio feedback between the first audio input and the first audio output.

In an example, the plurality of virtual channels of the virtual matrix comprises a first virtual channel arranged between the first audio input and the first audio output, and the one or more processors are arranged to detect the audio feedback between the first audio input and the first audio output and attenuate, via the first virtual channel, the first audio signal and provide an attenuated signal to the first audio output.

In an aspect, a method of eliminating audio feedback in an audio system is provided, the method including: receiving a first audio signal from a first audio input of the audio system; providing the first audio signal from the first audio input to a first audio output or a second audio output via one or more processors, the one or more processors including a first virtual input channel connected to the first audio input, a first virtual output channel connected to the first audio output, and a second virtual output channel connected to the second audio output; detecting, using audio feedback detection, an audio feedback between a first audio input and a first audio output or between the first audio input and a second audio output; attenuating or eliminating, via the one or more processors, the first audio signal to the first audio output; applying a gain, via the one or more processors, to the first audio signal or the second audio output.

In an example, a first processor of the one or more processors includes the first virtual input channel, the first virtual output channel, and the second virtual output channel; and a second processor of the one or more processors is arranged to receive the first audio signal and attenuate or eliminate the first audio signal if the audio feedback is detected.

In an example, the one or more processors further include a first virtual cross-point arranged between the first virtual input channel and a first virtual output channel connected to the first audio output; and, a second virtual cross-point arranged between the first virtual input channel and a second virtual output channel connected to the second audio output.

In an example, the one or more processors utilize audio feedback detection at the first virtual cross-point and the second virtual cross-point to detect the audio feedback between the first audio input and the first audio output or between the first audio input and the second audio output, and attenuate or eliminate the first audio signal to the first audio output or the second audio output.

In an example, the one or more processors are arranged to attenuate the first audio signal through the first virtual cross-point and provide a gain to the first audio signal through the second virtual cross-point, and wherein the one or more processors are arranged to eliminate the first audio signal through the first virtual cross-point and provide a gain to the first audio signal through the second virtual cross-point.

These and other aspects of the various embodiments will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various embodiments.

DETAILED DESCRIPTION

The present disclosure relates to systems and methods for eliminating feedback between audio inputs and audio outputs utilizing digital signal processing arranged between the audio inputs and the audio outputs. Utilizing digital signal processing between the audio inputs and audio outputs allows for each audio input signal to be discretely routed, attenuated, and/or eliminated such that if audio feedback between a first audio input and an first audio output is detected, the audio signal between the first audio input and the first audio output can be attenuated or eliminated while leaving the audio signals to any additional audio output unaffected. Alternatively, a processor for performing the digital signal processing may apply a gain to the audio signal between the first audio input and the second audio output to compensate for the loss from the attenuated or eliminated audio signal between the first audio input and the first audio output.

Figure 1:
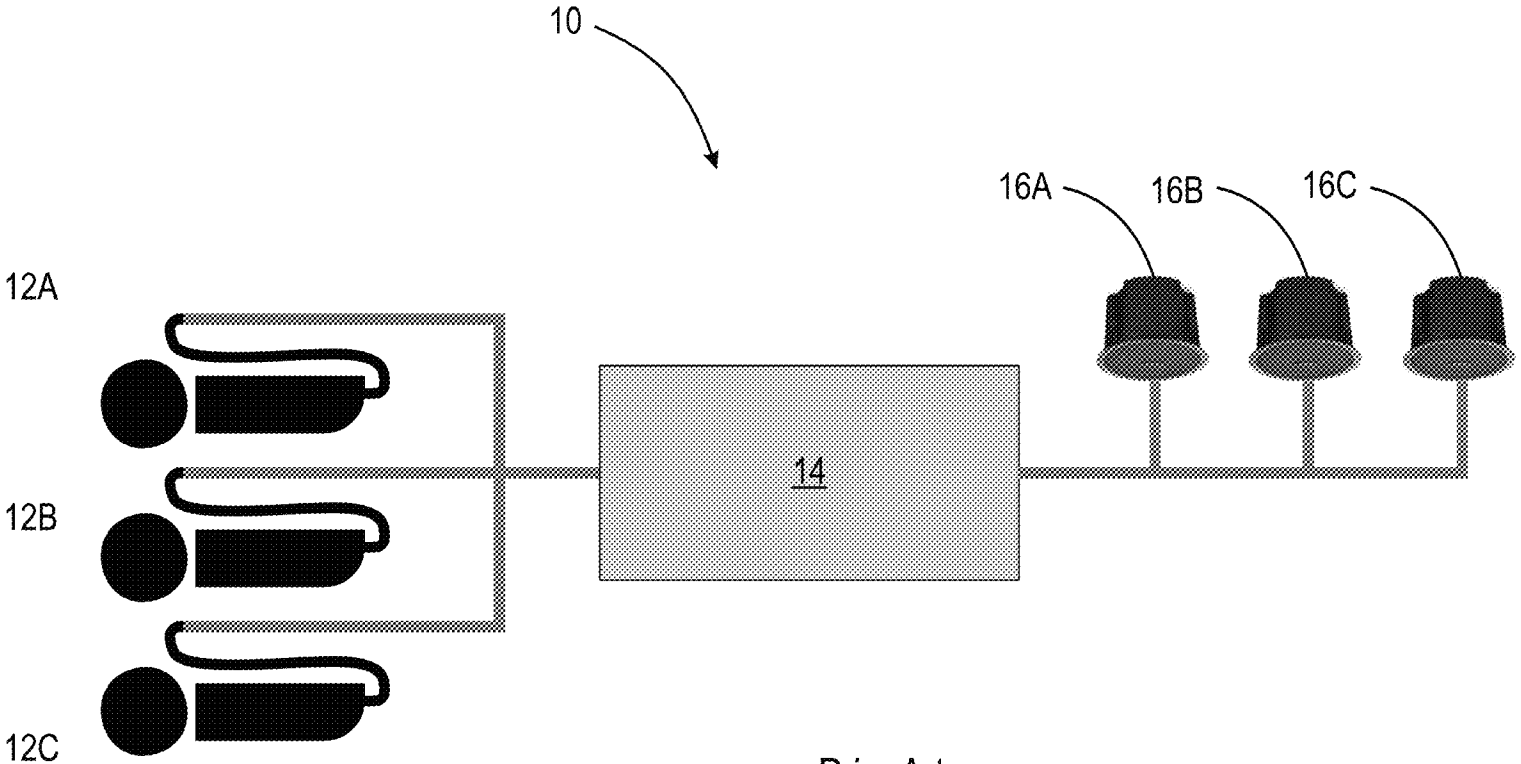
Prior Art Fig. 1
FIG. 1 is a schematic representation of an audio system according to the prior art.

Turning now to the figures, FIG. 1 is a schematic view of an audio system 10 according to the prior art. Audio system 10 includes a plurality of inputs 12A-12C connected to a dynamic filtering and feedback suppression system 14 which is connected to a plurality of audio outputs 16A-16C. If audio feedback is detected between, for example, audio input 12A and audio output 16A, the dynamic filtering and feedback suppression system 14 attenuates and/or eliminates the audio signal to all audio outputs of plurality of audio outputs 16A-16C to eliminate the audio feedback. The configuration of the prior art leads to audio loss and compromises overall sound quality.

Figure 2:
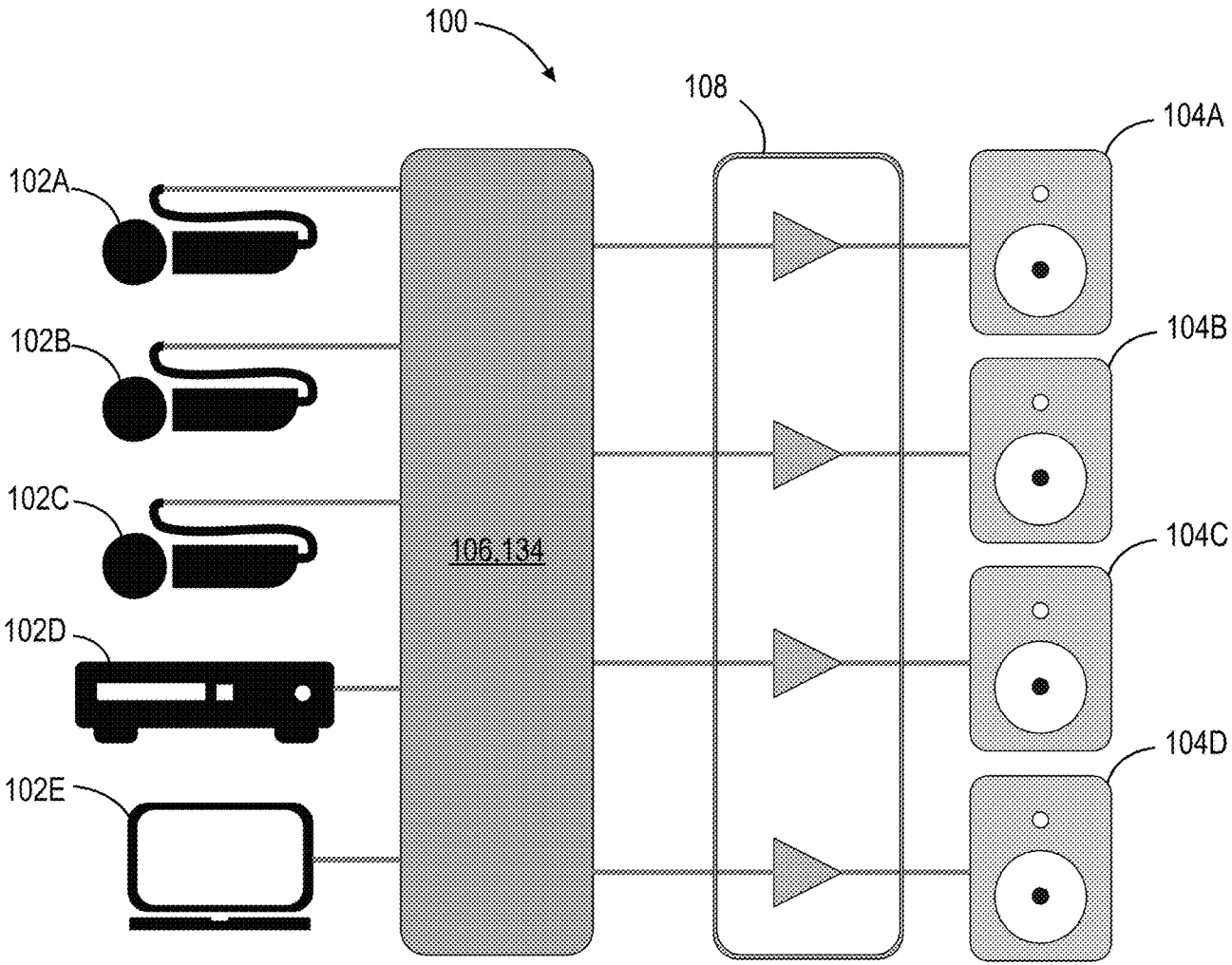
FIG. 2 is a schematic illustration of an audio system according to the present disclosure.

FIG. 2 illustrates a schematic representation of audio system 100 according to the present disclosure. Audio system 100 includes a plurality of audio inputs 102A-102E electrically connected to a plurality of audio outputs 104A-104D. Between plurality of audio inputs 102A-102E and plurality of audio outputs 104A-104D is a first processor 106, which will be discussed in detail below, and an amplifier 108. Each audio input of plurality of audio inputs 102A-102E may be selected from: a microphone, a media player, a multi-media player, a personal computer (PC), a server connected to a cloud-based network, a conferencing receiver device, a digital sound recorder, or any other source of analog or digital audio arranged to receive, convert, decode, or otherwise generate a digital audio signal, e.g., first audio signal 130A discussed below. Each audio output of plurality of audio outputs 104A-104C may be selected from: a telephone speaker, a television speaker, a radio speaker, a multimedia speaker, a conferencing transmitter device, a digital audio recorder, or any other device arranged to receive, convert, encode, transmit, or otherwise generate a digital audio signal, e.g., first audio signal 130A or attenuated signal 132 discussed below. It should also be appreciated that each audio input and each audio output may be a mono-channel or a multi-channel audio input and audio outputs.

Amplifier 108 is intended to be a physical device arranged to connect to, for example, each audio output of plurality of outputs 104A-104D, or integrated circuitry positioned on or in each audio output of plurality of outputs 104A-104D such that any audio signal 130A-130D, may be amplified, i.e., have a gain applied to the signal, to bring the audio back up after any compression that may take place in system 100. It should be appreciated that amplifier 108 is intended to be a multi-channel amplifier having a plurality of channels positioned between the DSP 106 and each audio output where each channel is capable of receiving one or more audio signals as a discrete signal corresponding to the audio inputs discussed above. It should also be appreciated that an external amplifier, e.g., amplifier 108 may not be necessary within system 100 as any necessary gains may be applied directly via first processor 106. It should also be appreciated that multiple amplifiers 108, where each amplifier 108 is connected to a single audio output or group of audio outputs may also be utilized.

Figure 3A:
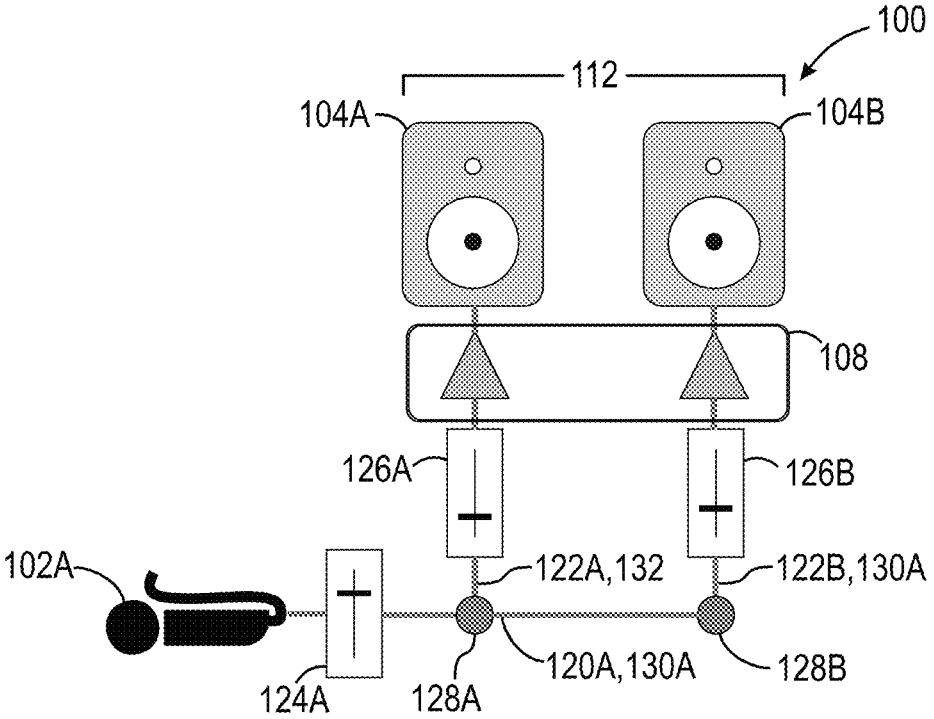
FIG. 3A is a schematic illustration of an audio system according to the present disclosure.
Figure 3B:
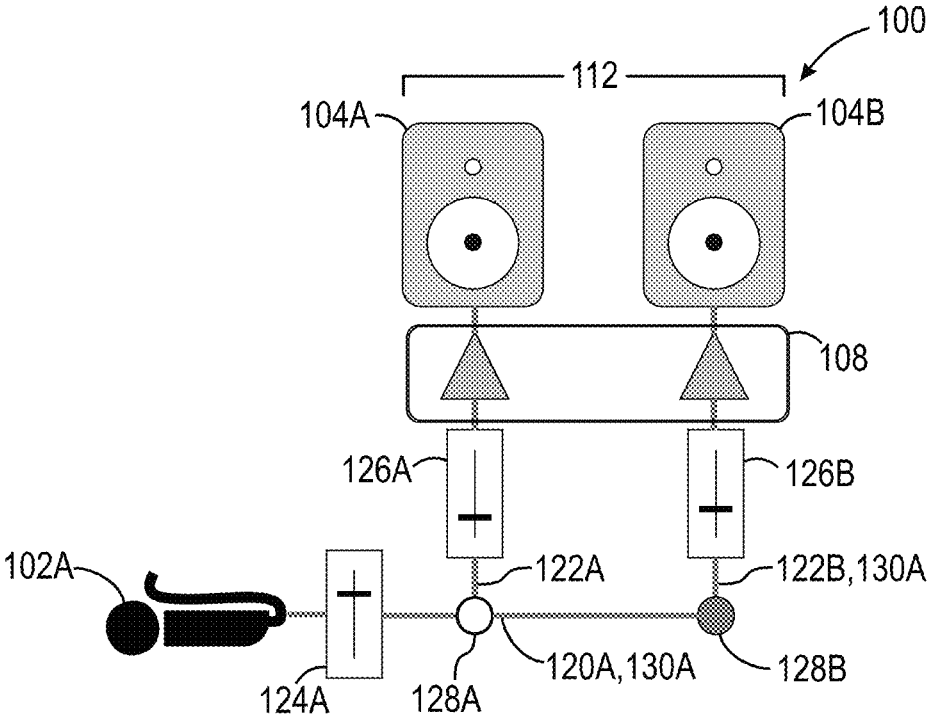
FIG. 3B is a schematic illustration of an audio system according to the present disclosure.

As illustrated in FIGS. 3A-5, system 100 may utilize at least one audio input and at least two audio outputs (as shown in FIGS. 3A and 3B). Each audio output 104A-104B may be assigned to one of a plurality of predefined zones 110 (shown in FIGS. 4 and 5), which may include first predefined zone 112 or second predefined zone 114 (shown in FIGS. 4 and 5). First predefined zone 112 and second predefined zone 114 may correspond to different rooms within a building, different areas within a single room or space, different areas at a concert venue or other public space, or are otherwise related to physically discrete zones where unified or substantially homogeneous sound quality is desired within each zone. Each predefined zone of plurality of predefined zones 110 may be assigned using the Graphical User Interface (GUI) 138 discussed below with respect to FIG. 7.

First processor 106 is intended to be Digital Signal Processor (DSP), i.e., a computational device arranged between plurality of audio inputs 102A-102E and plurality of audio outputs 104A-104C and capable of mixing, attenuating, and/or eliminating digital audio signals, e.g., first audio signal 130A discussed below, or determining, detecting, or otherwise sensing audio feedback between any audio input of plurality of audio inputs 102A-102E and any audio output of plurality of audio outputs 104A-104C by utilizing, for example, an audio feedback detection module 134 discussed below. It should be appreciated that first processor 106 may be a physical device between the audio inputs and the audio outputs capable of automatically detecting audio feedback between the audio inputs and the audio outputs and mixing, attenuating, and/or eliminating digital audio signals between the audio inputs and the audio outputs. To that end, and although not illustrated, it should be appreciated that first processor 106 may include a first memory arranged to store a first set of non-transitory computer-readable instructions to perform the functions of first processor 106 as discussed herein. Furthermore first processor 106 may be capable of establishing a data connection, both via a wired or wireless interface, to an external computing device, e.g., a personal computer or tablet, such that first processor 106 may work in concert with software executable on the computing device to perform the functions of first processor 106 as discussed herein. Although described throughout the present disclosure as a single processor 106, the functions of first processor 106 may be divided between one or more processors, i.e., first processor 106 and a second processor 107 (not illustrated). In one example embodiment, first processor 106 contains the virtual matrix 116 discussed below, while second processor 107 (not shown) is arranged to mix, attenuate, and/or eliminating digital audio signals, e.g., first audio signal 130A discussed below. It should also be appreciated that while first processor 106 may be positioned between the various audio inputs and audio outputs discussed herein, second processor 107, i.e., the processor arranged to mix, attenuate, and/or eliminate digital audio signals, may be positioned within or fixedly secured to any given audio input or any given audio output. In another example, each audio input and each audio output of system 100 includes a second processor 107 arranged to separately mix, attenuate, eliminate, or otherwise processes the various audio signals sent and received through system 100.

Figure 4:
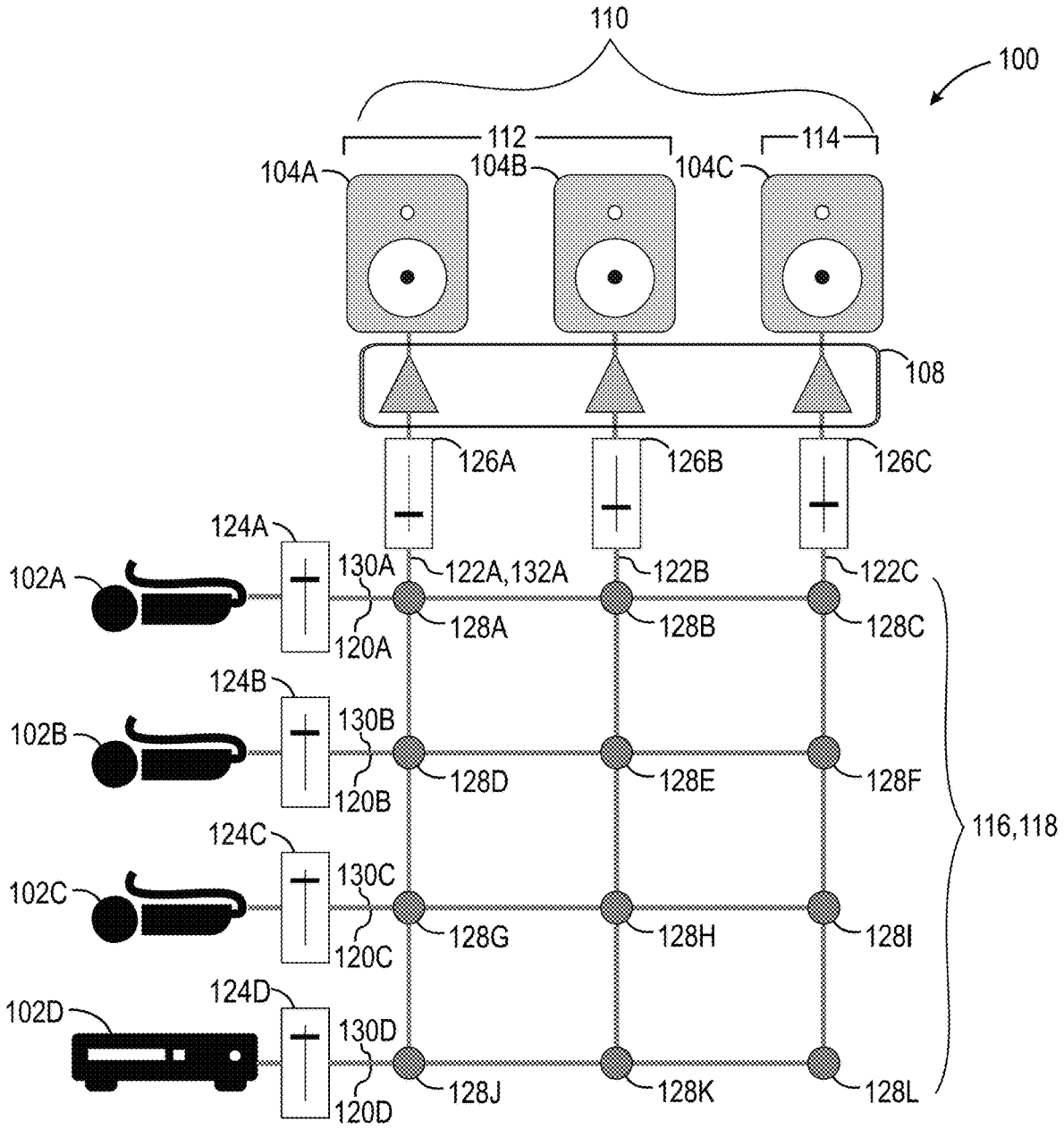
FIG. 4 is a schematic illustration of an audio system according to the present disclosure.
Figure 5:
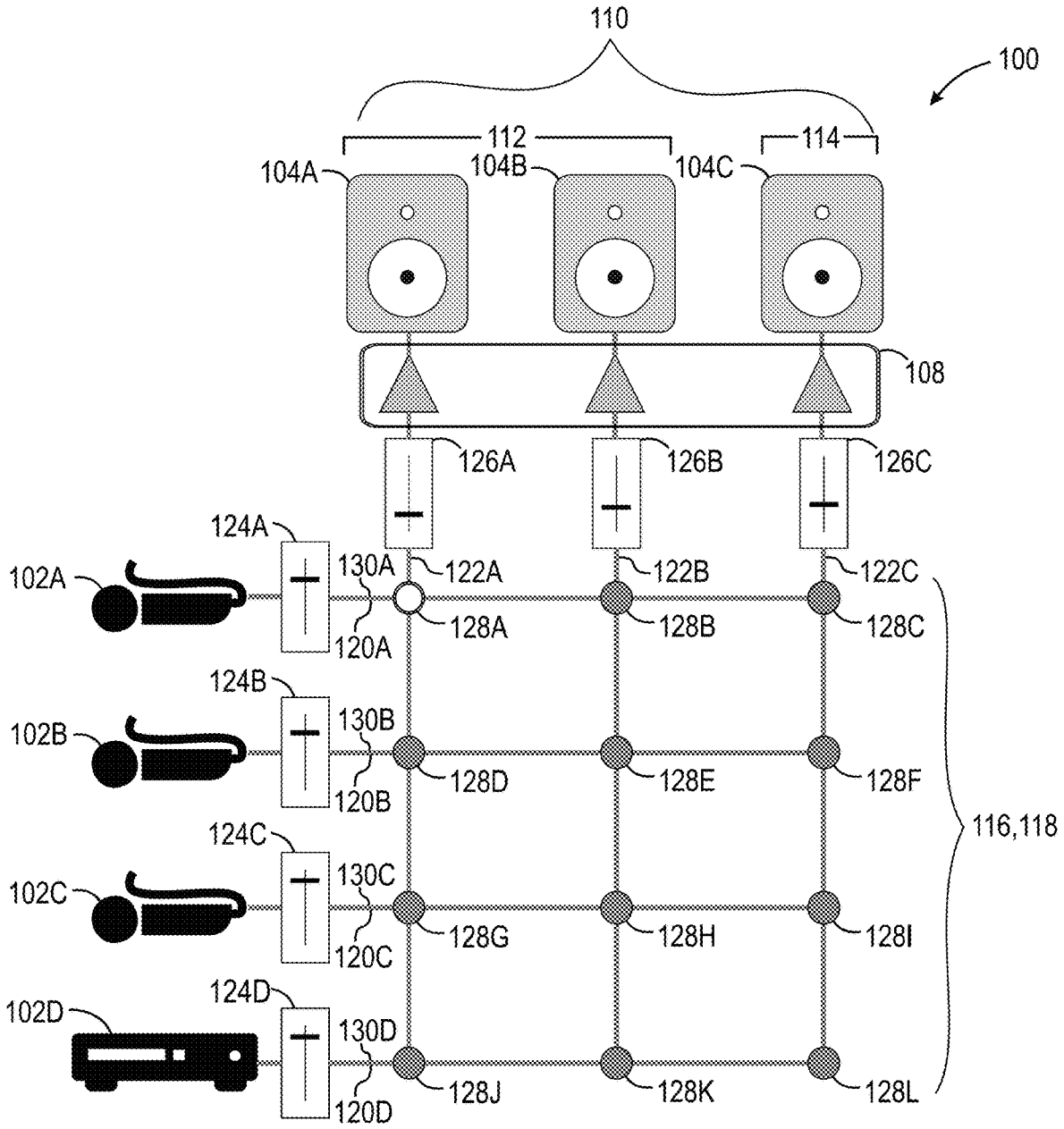
FIG. 5 is a schematic illustration of an audio system according to the present disclosure.

In one example, within first processor 106, a virtual matrix 116 is provided, the virtual matrix 116 may include a plurality of virtual channels 118 including a plurality of virtual input channels 120A-120D (shown in FIGS. 4 and 5) and a plurality of virtual output channels 122A-122C (shown in FIGS. 4 and 5). It should be appreciated that virtual matrix 116 can be employed as a user interface operation, i.e., may be employed via first graphical user interface 138 discussed below with respect to FIG. 6. As illustrated in FIGS. 3A and 3B, it should be appreciated that a single virtual input channel, e.g., first virtual input channel 120A, and multiple virtual output channels, e.g., first virtual output channel 122A and second virtual output channel 122B, may be utilized. First virtual input channel 120A can be associated with first audio input 102A, first virtual output channel 122A can be associated with first audio output 104A, and second virtual output channel 122B can be associated with second audio output 104B. Additionally, each virtual input channel of plurality of virtual input channels 120A-120D may be associated with an input volume control of a plurality of input volume controls 124A-124D and each virtual output channel of plurality of virtual output channels 122A-122C may be associated with an output volume control of a plurality of output volume controls 126A-126C. Each input volume control of plurality of input volume controls 124A-124D and each output volume control of plurality of output volume controls 126A-126C can be realized virtually or physically within first processor 106. For example, each input volume control and each output volume control may take the form of physically slidable or rotatable potentiometers fixedly secured to a housing of first processor 106 or may be fixedly secured to a separate apparatus, where the separate apparatus is electrically connected to first processor 106 such that as each slidable or rotatable potentiometer is translated or rotated, respectively, the volume or input gain may be adjusted proportionately to the magnitude of translation or rotation of the potentiometers. Alternatively, each input volume control and each output volume control may be implemented virtually, i.e., via the first set of non-transitory computer-readable instructions stored and executed by first processor 106. As shown in FIGS. 3A and 3B, first virtual input channel 120A can be associated with first input volume control 124A, first virtual output channel 122A can be associated with first output volume control 126A, and second virtual output channel 122B can be associated with second output volume control 126B.

As illustrated in FIGS. 3A-5, between each virtual input channel 120A-120D and each virtual output channel 122A-122C is a virtual cross-point, i.e., first processor 106 may further include a plurality of virtual cross-points 128A-128L. Each virtual cross-point is intended to schematically and virtually represent the exchange of the digital audio signal, e.g., first audio signal 130A, from a given virtual input channel to a given virtual output channel of plurality of virtual input channels 120A-120D and plurality of virtual output channels 122A-122C, respectively. As first processor 106 is intended mix, attenuate, and/or eliminate the digital audio signal sent between a given audio input of plurality of audio inputs 102A-102E and a given audio output of plurality of audio outputs 104A-104C, the mixing, attenuating, and/or eliminating can be visualized as happening at a virtual point between the given audio input and the given audio output, i.e., at a virtual cross-point of plurality of virtual cross-points 128A-128L.

During operation of system 100, each audio input of plurality of audio inputs 102A-102E are arranged to receive or otherwise generate a respective audio signal, i.e., an audio signal of plurality of audio signals 130A-130D (not shown). Each audio signal 130A-130E is intended to be a digital audio signal, encoded by its respective audio input 102A-102E or a connected to its respective audio input 102A-102E, and arranged to be transmitted to first processor 106 via a wired or wireless interface. First processor 106 is then arranged to transmit the respective audio signal through at least one virtual input channel 120A-120D, at least one virtual cross-point 128A-128L, and at least one virtual output channel 122A-122C. While within first processor 106, the respective audio signal may be mixed, and/or attenuated, and/or eliminated within a particular virtual cross-point 128A-128L. First processor 106 may then transmit, via a wired or wireless interface, an attenuated or mixed signal 132A-132D to a given audio output of plurality of audio outputs 104A-104C directly, or through a multi-channel amplifier, for example, amplifier 108.

First processor 106 further includes an audio feedback module 134 (shown in FIG. 2) which may utilize audio feedback detection algorithms to determine, detect, sense, and/or suppress, an audio feedback, e.g., feedback signals having a particular frequency or amplification between any given audio input and any given audio output of system 100. Audio feedback module 134 may then employ a plurality of dynamic or static filters arranged to notch out or eliminate specific frequency ranges of a particular audio bandwidth that have been determined to contribute to the audio feedback detected between a given audio input and audio output.

In one example illustrated in FIG. 3A, system 100 includes first processor 106. In the example illustrated, first processor 106 is electrically connected to a first audio input 102A, a first audio output 104A, and a second audio output 104B. In an example, a multi-channel amplifier 108 is connected between each audio output 104A-104B and first processor 106. If the first processor 106 detects or senses an audio feedback between, for example, first audio input 102A and first audio output 104A using audio feedback module 134, first processor 106 may, at virtual cross-point 128A, attenuate audio signal 130A creating attenuated signal 132A such that any feedback between first audio input 102A and first audio output 104A is reduced or eliminated completely. It should be noted that, as the attenuation of audio signal 130A to attenuated audio signal 132A is applied only to audio signal between first audio input 102A and first audio output 104A, i.e., audio signal 130A, audio signals 130B-130D, for example, may remain unaffected as they pass through first processor 106 to first audio output 104A or through any other cross-point of plurality of cross-points 128B-128L. It should also be appreciated that the attenuation of audio signal 130A to attenuated signal 132A may reduce overall volume or sound quality within the first predetermined zone 112. As such, a gain may be applied, i.e., gain 136, to, for example, audio signal 130B to compensate for the loss of volume and/or sound quality produced by attenuated signal 132A through first audio output 104A. Gain 136 may be provided automatically via the first set of non-transitory computer-readable instructions of the first processor 106 or may be provided manually via the input volume control 124A or output volume control 126B.

Similarly, in one example illustrated in FIG. 3B, system 100 includes first processor 106. In the example illustrated, first processor 106 is electrically connected to a first audio input 102A, a first audio output 104A, and a second audio output 104B. In an example, a multi-channel amplifier 108 is connected between each audio output 104A-104B and first processor 106. If the first processor 106 detects or senses an audio feedback between, for example, first audio input 102A and first audio output 104A using audio feedback module 134, first processor 106 may, at virtual cross-point 128A, eliminate audio signal 130A (illustrated with an open circle at cross-point 128A) such that any feedback between first audio input 102A and first audio output 104A is eliminated completely. It should be noted that, as the elimination of audio signal 130A is applied only to the connection between first audio input 102A and first audio output 104A, audio signal 130B, for example, may remain unaffected. It should also be appreciated that the elimination of audio signal 130A may reduce overall volume or sound quality within the first predetermined zone 112. As such, a gain may be applied, i.e., gain 136, to, for example, audio signal 130B to compensate for the loss of volume and/or sound quality produced by the elimination of audio signal 130A through first audio output 104A. Gain 136 may be provided automatically via the first set of non-transitory computer-readable instructions of the first processor or may be provided manually via the input volume control 124A or output volume control 126B.

In an example, as illustrated in FIGS. 4 and 5, audio system 100 may include multiple audio inputs 102A-102D and multiple audio outputs 104A-104C. Each audio output of plurality of audio outputs 104A-104C may be assigned to one of a plurality of predefined zones 110, i.e., first predefined zone 112 and second predefined zone 114. In the example illustrated in FIGS. 4 and 5, audio output 104A and audio output 104B are assigned to first predefined zone 112 and audio output 104C is assigned to a second predefined zone 114. Additionally, first processor 106 includes virtual matrix 116 of plurality of virtual channels 118. Audio inputs 102A-102C may be microphones, while audio input 102D can be a multi-media player. Audio outputs 104A-104C are intended to be speakers. Although illustrated as microphones, multi-media players, and/or speakers, it should be appreciated that audio inputs 102A-102D and audio outputs 104A-104C can be any of the audio inputs or audio outputs listed above.

First virtual input channel 120A within DSP 106 is virtually connected to first virtual output channel 122A, second virtual audio output channel 122B, and third virtual audio output channel 122C. First virtual input channel 120A is connected to first virtual output channel 122A at virtual cross-point 128A, first virtual input channel 120A is connected to second virtual output channel 122B at virtual cross-point 128B, and first virtual input channel 120A is connected to third virtual output channel 122C at virtual cross-point 128C.

Second virtual input channel 120B within first processor 106 is virtually connected to first virtual output channel 122A, second virtual audio output channel 122B, and third virtual audio output channel 122C. Second virtual input channel 120B is connected to first virtual output channel 122A at virtual cross-point 128D, second virtual input channel 120B is connected to second virtual output channel 122B at virtual cross-point 128E, and second virtual input channel 120B is connected to virtual output channel 122C at virtual cross-point 128F.

Third virtual input channel 120C within first processor 106 is virtually connected to first virtual output channel 122A, second virtual audio output channel 122B, and third virtual audio output channel 122C. Third virtual input channel 120C is connected to first virtual output channel 122A at virtual cross-point 128G, third virtual input channel 120C is connected to second virtual output channel 122B at virtual cross-point 128H, and third virtual input channel 120C is connected to virtual output channel 122C at virtual cross-point 128I.

Fourth virtual input channel 120D within first processor 106 is virtually connected to first virtual output channel 122A, second virtual audio output channel 122B, and third virtual audio output channel 122C. Fourth virtual input channel 120D is connected to first virtual output channel 122A at virtual cross-point 128J, fourth virtual input channel 120D is connected to second virtual output channel 122B at virtual cross-point 128K, and fourth virtual input channel 120D is connected to virtual output channel 122C at virtual cross-point 128L.

As illustrated in FIG. 4, if the first processor 106 detects or senses an audio feedback between, for example, first audio input 102A and first audio output 104A using audio feedback module 134, first processor 106 may, at virtual cross-point 128A, attenuate audio signal 130A creating attenuated signal 132A such that any feedback between first audio input 102A and first audio output 104A is reduced or eliminated completely. It should be noted that, as the attenuation of audio signal 130A to attenuated audio signal 132A is applied only to the connection between first audio input 102A and first audio output 104A, audio signal 130B, for example, may remain unaffected. Additionally, the remaining audio signals 130B-130D may pass through virtual cross-point 128A unaffected. It should also be appreciated that the attenuation of audio signal 130A to attenuated signal 132 may reduce overall volume or sound quality within the first predetermined zone 112. As such, a gain may be applied, i.e., gain 136 to audio signal 130B to audio output 104B within first predefined zone 112 to compensate for the loss of volume and/or sound quality produced by attenuated signal 132A through first audio output 104A in first predefined zone 112. Gain 136 may be provided automatically via the first set of non-transitory computer-readable instructions of the first processor 106 or may be provided manually via the input volume control 124A or output volume control 126B. It should be appreciated that attenuation may occur within first processor 106 at any cross-point 128A-128L such that the audio signals at the other remaining cross-points may remain unaffected.

Alternatively, as illustrated in FIG. 5, if the first processor 106 detects or senses an audio feedback between, for example, first audio input 102A and first audio output 104A using audio feedback module 134, first processor 106 may, at virtual cross-point 128A, eliminate audio signal 130A such that any feedback between first audio input 102A and first audio output 104A is eliminated completely. It should be noted that, as the elimination of audio signal 130A is applied only to the connection between first audio input 102A and first audio output 104A, i.e., audio signal 130A, audio signals 130B-130D, for example, may remain unaffected as they pass through virtual cross-point 128A or any other virtual cross-point within virtual matrix 116. It should also be appreciated that the elimination of audio signal 130A (illustrated by an open circle at cross-section 128A) may reduce overall volume or sound quality within the first predetermined zone 112. As such, a gain may be applied, i.e., gain 136 to audio signal 130B to audio output 104B within first predefined zone 112 to compensate for the loss of volume and/or sound quality produced by the elimination of audio signal 130A through first audio output 104A in first predefined zone 112. Gain 136 may be provided automatically via the first set of non-transitory computer-readable instructions of the first processor 106 or may be provided manually via the input volume control 124A or output volume control 126B. It should be appreciated that elimination of a given audio signal may occur within first processor 106 at any cross-point 128A-128L such that the audio signals at the other remaining cross-points may remain unaffected.

Figure 6:
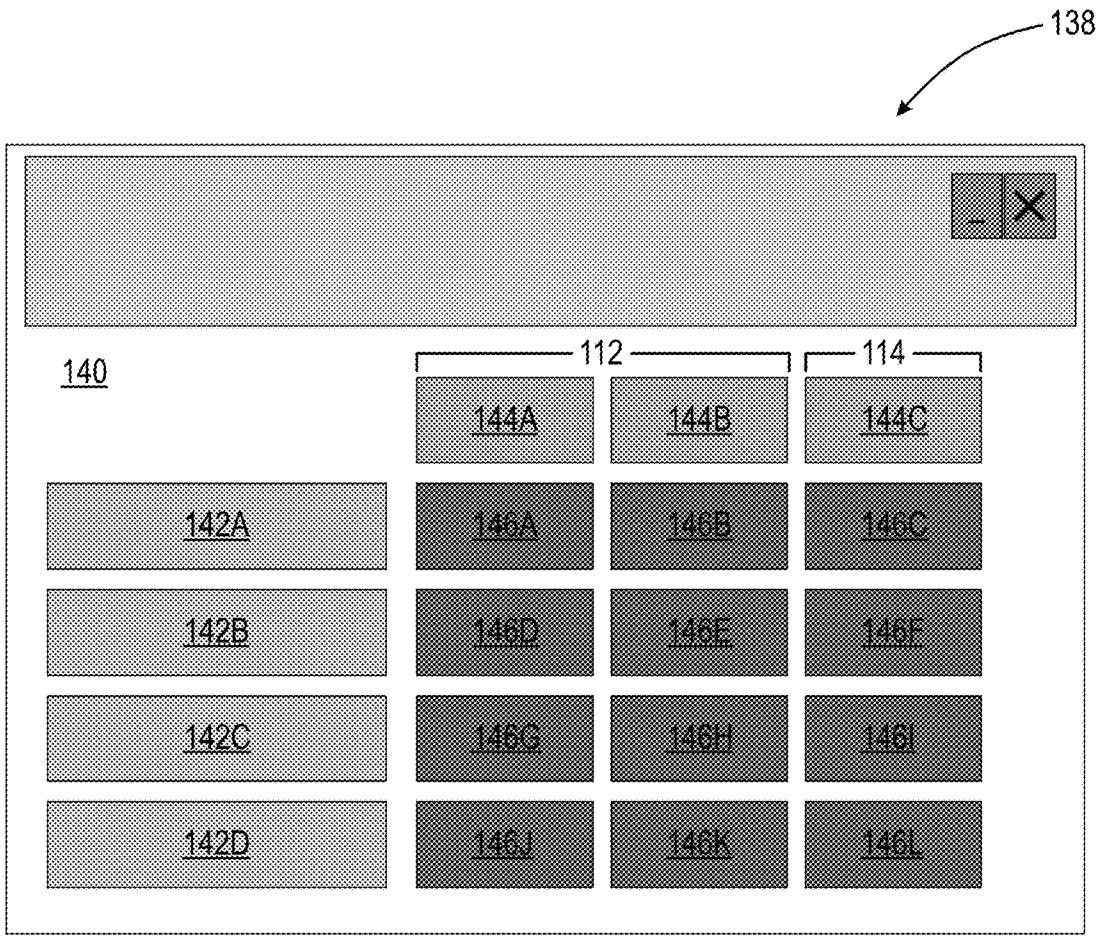
FIG. 6 is a schematic illustration of a graphical user interface according to the present disclosure.

As illustrated in FIG. 6, first processor 106 and/or a computing device connected to first processor 106, via a wired or wireless interface, may present a user setting up system 100 with a graphical user interface (GUI), i.e., GUI 138. GUI 138 may be provided on first processor 106 and/or the computing devices connected to first processor 106, via a screen or display. GUI 138 may include a window having a plurality of input fields 142A-142E to designate and assign to any audio input of plurality of audio inputs 102A-102E, a plurality of output fields 144A-144C to designate and assign to any audio output of plurality of audio outputs 104A-104C and group them in predefined zones (e.g., predefined zones 112 and 114), and plurality of cross-point fields 146A-146L to control the individual alterations described above at cross-points 128A-128L, e.g., attenuation and/or elimination. The user may, for example, select and type the name of a particular audio input device to assign each audio input 102A-102D, to each given input field 142A-142D. Once assigned GUI 138 and the first set of non-transitory computer-readable instructions of first processor 106 will assign each audio input 102A-102D to a virtual input channel, e.g., virtual input channels 120A-120D, respectively. The user may also, for example, select and type the name of a particular audio output device of audio outputs 104A-104C, to each given output field 144A-144C and select or assign each audio output to a predefined zone, e.g., first predefined zone 112 or second predefined zone 114. Once assigned, GUI 138 and the first set of non-transitory computer-readable instructions of first processor 106 will assigned each audio output 104A-104C to a virtual output channel, e.g., virtual output channels 122A-122C, respectively. The user may further establish by selecting individual cross-point fields 146-146L, the cross-points 128A-128L that the user would like to utilize audio feedback suppression module 134 to detect the audio feedback described above and take action to attenuate, eliminate, or suppress the detected audio at each respective virtual cross-point 128A-128L.

In the examples described above, it should be appreciated that, although illustrated and described using attenuation or elimination through virtual cross-point 128A and/or providing a gain, i.e., gain 136 through virtual cross-point 128B, attenuation, elimination, suppression, and/or any gains may be applied independently to each audio signal 130A-130D at any cross-point 128A-128L of virtual matrix 116.

Figure 7:
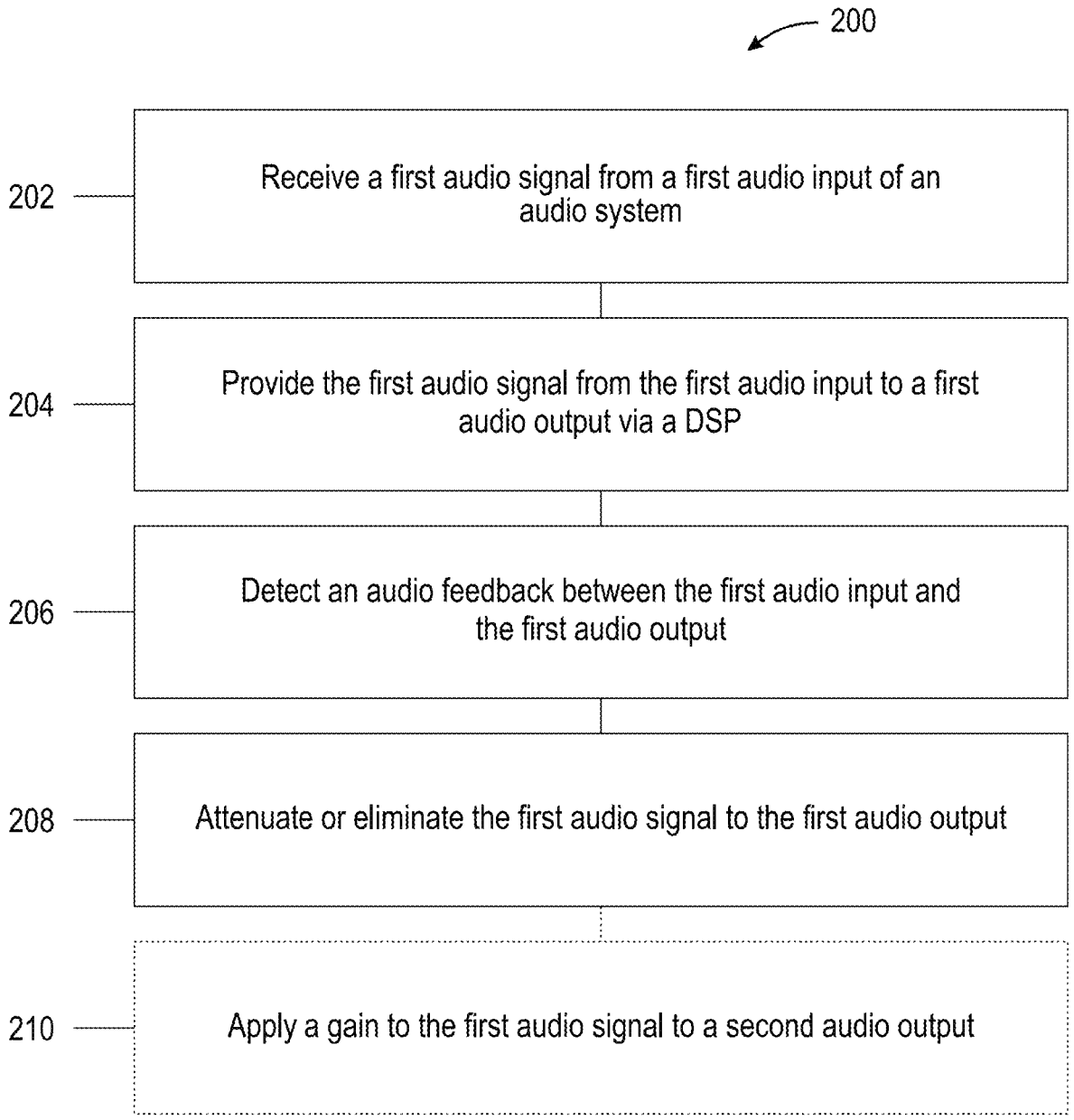
FIG. 7 is a flow chart illustrating the steps of a method according to the present disclosure.

FIG. 7 illustrates a flow chart of method 200 according to the present disclosure. Method 200 may include, for example: receiving a first audio signal 130A from a first audio input 102A of the audio system 100 (step 202); providing the first audio signal 130A from the first audio input 102A to a first audio output 104A or a second audio output 104B via one or more processors (106,107), the one or more processors (106,107) including a first virtual input channel 120A connected to the first audio input 102A, a first virtual output channel 122A connected to the first audio output 104A, and a second virtual output channel 122B connected to the second audio output 104B (step 204); detecting, using audio feedback detection, an audio feedback between a first audio input 102A and a first audio output 104A or between the first audio input 102A and a second audio output 104B (step 206); attenuating or eliminating, via the one or more processors (106,107), the first audio signal 130A to the first audio output 104A (step 208); and optionally, applying a gain 136, via the one or more processors (106,107), to the first audio signal 130A to the second audio output 104B (step 210).

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The above-described examples of the described subject matter can be implemented in any of numerous ways. For example, some aspects may be implemented using hardware, software or a combination thereof. When any aspect is implemented at least in part in software, the software code can be executed on any suitable processor or collection of processors, whether provided in a single device or computer or distributed among multiple devices/computers.

The present disclosure may be implemented as a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to examples of the disclosure. It will be understood that each block of the flowchart illustrations and/or block diagrams, and combinations of blocks in the flowchart illustrations and/or block diagrams, can be implemented by computer readable program instructions.

The computer readable program instructions may be provided to a processor of a, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various examples of the present disclosure. In this regard, each block in the flowchart or block diagrams may represent a module, segment, or portion of instructions, which comprises one or more executable instructions for implementing the specified logical function (s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Other implementations are within the scope of the following claims and other claims to which the applicant may be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific examples described herein. It is, therefore, to be understood that the foregoing examples are presented by way of example only and that, within the scope of the appended claims and equivalents thereto, examples may be practiced otherwise than as specifically described and claimed. Examples of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. An audio system for eliminating audio feedback comprising:

a first audio input arranged to receive a first audio signal;

a first audio output arranged within a first predefined zone, the first audio output arranged to receive the first audio signal;

a second audio output arranged within the first predefined zone, the second audio output arranged to receive the first audio signal;

one or more processors connected to a virtual matrix including a plurality of virtual channels connecting the first audio input, the first audio output, and the second audio output, and the one or more processors arranged to receive the first audio signal and attenuate or eliminate the first audio signal to the first audio output or the second audio output if an audio feedback is detected by the one or more processors.

2. The audio system of claim 1, wherein a first processor of the one or more processors includes the virtual matrix and a second processor of the one or more processors is arranged to receive the first audio signal and attenuate or eliminate the first audio signal if the audio feedback is detected.

3. The audio system of claim 1, wherein the one or more processors utilize audio feedback detection to detect the audio feedback between the first audio input and the first audio output or the audio second output.

4. The audio system of claim 3, wherein the one or more processors are arranged to detect the audio feedback between the first audio input and the first audio output and attenuate, via the first virtual input channel, the first audio signal and provide an attenuated signal to the first audio output.

5. The audio system of claim 3, wherein the one or more processors are arranged to detect the audio feedback between the first audio input and the first audio output and eliminate, via the first virtual channel, the first audio signal to the first audio output.

6. The audio system of claim 3, further comprising:

a first virtual cross-point arranged between the first virtual input channel and a first virtual output channel connected to the first audio output; and, a second virtual cross-point arranged between the first virtual input channel and a second virtual output channel connected to the second audio output.

7. The audio system of claim 6, wherein the one or more processors are arranged to attenuate the first audio signal through the first virtual cross-point and provide a gain to the first audio signal through the second virtual cross-point, and wherein the one or more processors are arranged to eliminate the first audio signal through the first virtual cross-point and provide a gain to the first audio signal through the second virtual cross-point.

8. The audio system of claim 1, wherein the plurality of virtual channels of the virtual matrix comprises a first virtual input channel arranged between the first audio input and the first audio output and between the first audio input and the second audio output.

9. The audio system of claim 8, wherein the one or more processors are arranged to provide a gain to the second audio output in the first predefined zone to compensate for the attenuated signal to the first audio output.

10. The audio system of claim 9, wherein the one or more processors are arranged to provide a gain to the second audio output in the first predefined zone to compensate the eliminated signal to the first audio output.

11. The audio system of claim 10, wherein, the one or more processors utilize audio feedback detection at the first virtual cross-point and the second virtual cross-point to detect the audio feedback between the first audio input and the first audio output or between the first audio input and the second audio output, and attenuate or eliminate the first audio signal to the first audio output or the second audio output.

12. An audio system for eliminating audio feedback comprising:

a first audio input arranged to receive a first audio signal;

a first audio output arranged within a first predefined zone, the first audio output arranged to receive the first audio signal;

a second audio output arranged within the first predefined zone, the second audio output arranged to receive the first audio signal;

one or more processors connecting the first audio input, the first audio output, and the second audio output, with one or more virtual channels of a plurality of virtual channels, the one or more processors arranged to receive the first audio signal and attenuate the first audio signal to the first audio output or the second audio output if an audio feedback is detected.

13. The audio system of claim 12, wherein a first processor of the one or more processors includes a virtual matrix and a second processor of the one or more processors is arranged to receive the first audio signal and attenuate the first audio signal if the audio feedback is detected.

14. The audio system of claim 12, wherein the one or more processors utilize audio feedback detection to detect the audio feedback between the first audio input and the first audio output.

15. The audio system of claim 12, wherein a first processor of the one or more processors includes a virtual matrix that comprises the plurality of virtual channels, wherein the plurality of virtual channels of the virtual matrix comprises a first virtual channel arranged between the first audio input and the first audio output, and the one or more processors are arranged to detect the audio feedback between the first audio input and the first audio output and attenuate, via the first virtual channel, the first audio signal and provide an attenuated signal to the first audio output.

16. A method of eliminating audio feedback in an audio system comprising:

receiving a first audio signal from a first audio input of the audio system;

providing the first audio signal from the first audio input to a first audio output and a second audio output via one or more processors, the one or more processors including a first virtual input channel connected to the first audio input, a first virtual output channel connected to the first audio output, and a second virtual output channel connected to the second audio output;

detecting, using audio feedback detection, an audio feedback between a first audio input and a first audio output or between the first audio input and a second audio output;

attenuating or eliminating, via the one or more processors, the first audio signal to the first audio output;

applying a gain, via the one or more processors, to the first audio signal or the second audio output.

17. The method of claim 16, wherein a first processor of the one or more processors includes the first virtual input channel, the first virtual output channel, and the second virtual output channel; and a second processor of the one or more processors is arranged to receive the first audio signal and attenuate or eliminate the first audio signal if the audio feedback is detected.

18. The method of claim 17 wherein, the one or more processors utilize audio feedback detection at the first virtual cross-point and the second virtual cross-point to detect the audio feedback between the first audio input and the first audio output or between the first audio input and the second audio output, and attenuate or eliminate the first audio signal to the first audio output or the second audio output.

19. The method of claim 16, wherein the one or more processors further comprise:

a first virtual cross-point arranged between the first virtual input channel and a first virtual output channel connected to the first audio output; and, a second virtual cross-point arranged between the first virtual input channel and a second virtual output channel connected to the second audio output.

20. The method of claim 19, wherein the one or more processors are arranged to attenuate the first audio signal through the first virtual cross-point and provide a gain to the first audio signal through the second virtual cross-point, and wherein the one or more processors are arranged to eliminate the first audio signal through the first virtual cross-point and provide a gain to the first audio signal through the second virtual cross-point.

* * * * *